United States Patent [19]

Johnson

[11] 4,122,563

[45] Oct. 31, 1978

[54] TOILET SEAT ASSEMBLY

[75] Inventor: C. Evan Johnson, Onekama, Mich.

[73] Assignee: Hitachi Magnetics Corp., Edmore, Mich.

[21] Appl. No.: 749,301

[22] Filed: Dec. 10, 1976

[51] Int. Cl.[2] ..... A47K 13/12

[52] U.S. Cl. ..... 4/236; 16/DIG. 14

[58] Field of Search ..... 4/236, 234, 240, 237, 4/239, 241, 1; 16/128, 82, DIG. 14

[56] References Cited

U.S. PATENT DOCUMENTS

| | | | |
|---|---|---|---|
| 3,016,563 | 1/1962 | De Jong | 16/DIG. 14 |
| 3,152,716 | 10/1964 | Feldhahn | 16/DIG. 14 |
| 3,653,077 | 4/1972 | Warnberg | 4/236 |

*Primary Examiner*—Richard E. Aegerter
*Assistant Examiner*—Willis Little
*Attorney, Agent, or Firm*—Allard A. Braddock

[57] ABSTRACT

A hinged toilet seat and cover assembly has at least two magnetic latches positioned to control the movement of the seat and cover. A first magnetic latch positioned between the hinge and cover serves to hold the cover in a vertical position once the cover has been raised to such position. A second magnetic latch positioned between the cover and seat at a point spaced from the hinge serves to hold the cover and seat in contact with each other once they are brought into such contact.

4 Claims, 2 Drawing Figures

TOILET SEAT ASSEMBLY

BACKGROUND OF THE INVENTION

A "magnetic latch" consists of a permanent magnet attached to one member of a pair of members which are movable with respect to each other and some magnetic material positioned on the other member to provide a "keeper" for the magnet when the two members are in a particular position. In cases where the material of the member itself or the portion of the material contacted by the poles of the permanent magnet in a closed position, is composed of magnetic material, the member can serve as the keeper. The keeper does not have to make actual contact with the magnet in order to operate satisfactorily. In order to avoid the marring and scratching which would occur on metal-to-metal contact, it is not infrequent that protective layers of elastomeric or other material are placed between the magnet and keeper when the latch is in closed position.

Magnetic latches usually have no moving parts and rely entirely upon magnetic attraction to maintain members in a particular position. Release is obtained by the application of sufficient manual effort to overcome magnetic attraction between members in such position. This constitutes an easy release feature which has resulted in the widespread use of magnetic latches in such applications as refrigerator and cabinet doors. The magnet can be on either of the members being latched. For example, the magnet can be attached to the door of a refrigerator and the keeper to the box portion of the refrigerator or these positions may be reversed. A latch can also be made of two magnets arranged for metal attraction in latching position. A magnetic latch can also be used for holding one member in a desired position with respect to another even though the desired position is not a "closed" position. Thus, as used herein, a magnetic latch between a pair of members describes a structure in which at least one permanent magnet positioned on a first member selectively maintains the position of a second member with respect to the first member.

SUMMARY OF THE INVENTION

A toilet seat assembly has a seat and cover connected to a centrally positioned hinge. The hinge has a stationary or fixed portion which includes a pair of bolts utilized for connecting the assembly to a toilet bowl. A magnetic latch extending between the stationary portion of the hinge and the edge of the cover connected to the hinge has at least one magnetic latch which magnetically biases the cover to a vertical position when the assembly is mounted on a toilet bowl. Another magnetic latch extends between the seat and cover at a point spaced some distance from the hinge. This other magnetic latch is magnetically biased to hold the seat and cover close together.

DESCRIPTION OF THE PREFERRED EMBODIMENT

Figure 1:
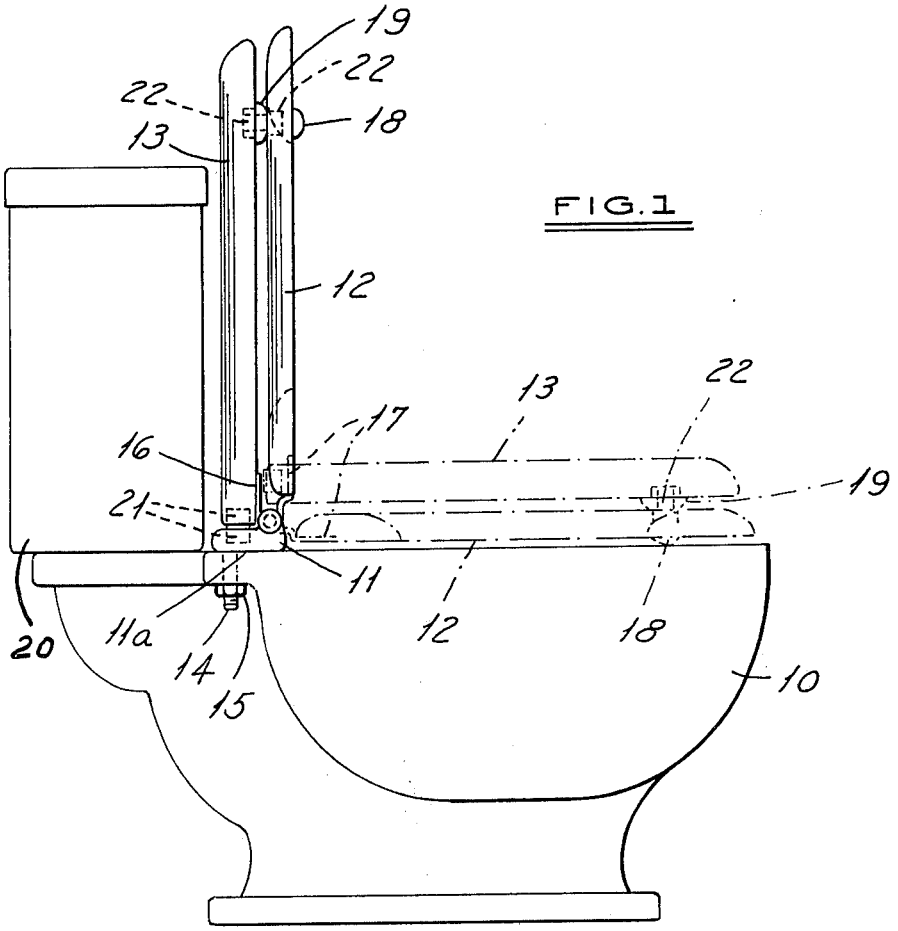
FIG. 1 is a side view of a toilet bowl on which is mounted a seat and cover assembly.

In FIG. 1 a conventional toilet bowl 10 equipped with a water reservoir 20 is composed of ceramic material and has a pair of apertures (not shown) used for mounting a hinge 11 usually composed of a metal such as brass or plated ferrous material, to which is attached a toilet seat 12 and a cover 13, both of which are usually composed of wood or a plastic material. Typically, the hinge 11 is equipped with a pair of spaced intergral bolts 14 which extend through the apertures of the toilet bowl 10. A nut 15 is tightened on each bolt 14 to attach the hinge 11 to the toilet bowl.

Figure 2:
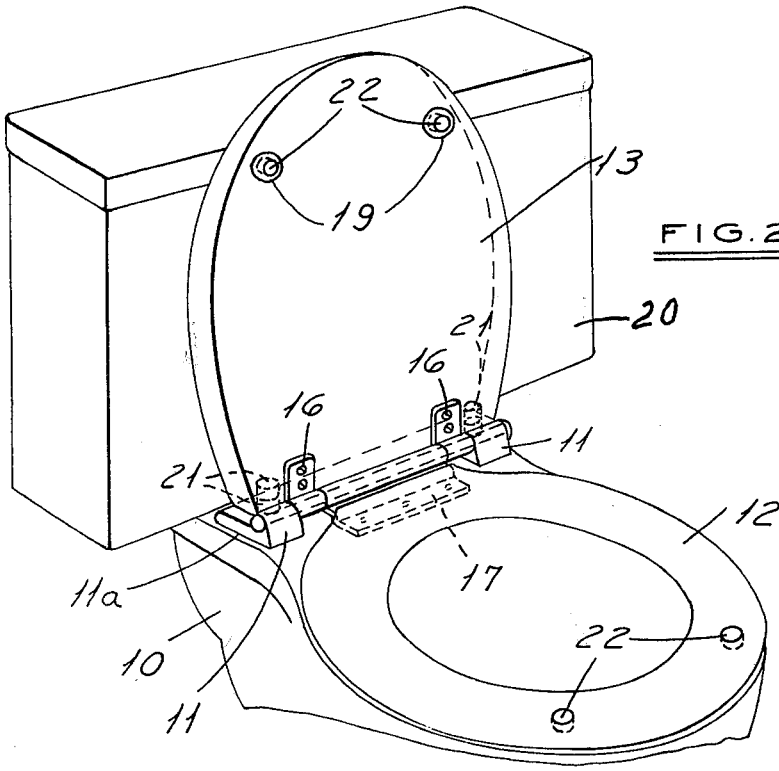
FIG. 2 is a broken perspective view of a toilet with a seat and cover assembly illustrating the invention.

As shown in FIG. 1, the hinge 11 has a base portion **11*a* which remains stationary with respect to the toilet bowl 10 after the assembly has been positioned on the toilet bowl. The hinge 11 also includes a first pair of pivot arms 16 to which the cover 13 is fastened as best illustrated in FIG. 2. The hinge 11 also includes a second set of pivot arms 17 to which the seat 12 is fastened. The pivot arms 16 and 17 allow limited rotation of the seat 12 and cover 13 around the hinge 11**.

Since the seat 12 and cover 13 are frequently shifted singly or together from a horizontal to a vertical position or vice versa, the seat 12 is equipped with a bumper 18 (FIG. 1) and the cover 13 with a bumper 19 composed of rubber or a similar elastomeric material. These bumpers serve to protect the toilet bowl 10 and the seat and cover from damage during the back-and-forth shifting between horizontal and vertical positions.

The description so far has been directed to parts which would be present in a conventional seat and cover assembly. After a period of use such assemblies are apt to pivot rather easily with the result that a seat and cover in upright or vertical position can slam down unexpectedly. This is particularly the case where the reservoir 20 is close to the cover and the parts are covered with a cloth such as chenille or velvet. The cloth covering has the effect of reducing the over-center movement of the cover with the result that unexpected slamdowns can occur regularly.

In order to hold the cover in an upright or vertical position, a first magnetic latch 21 is positioned between the stationary portion **11*a* of the hinge 11 and the edge of the cover 13 nearest the hinge 11. As illustrated in FIG. 1, the portion of the latch 21 positioned in the hinge 11 is a permanent magnet. The keeper portion of the latch 21 in the cover 13 consists of a steel plug embedded in the material of the cover. When the cover 13 is raised to vertical position, the attraction between the magnet and keeper of the latch 21 is at a maximum and the cover 13 is then firmly held in vertical position by magnetic bias. This magnetic bias can be overcome by lowering the cover 13 to closed position with the result that the gap between the magnet and keeper of the latch 21** is widened sufficiently to reduce the attraction of the parts for each other and the weight of the cover holds it in closed position.

The latch 21 would operate in the same manner if the magnet were positioned in the cover 13 and the plug embedded in the stationary portion **11*a* of the hinge 11. If the magnet is embedded in the cover and the stationary portion 11*a*** is composed of a magnetic material such as steel (which may be chromium plated), the steel plug may be omitted as the material of the hinge itself will serve as the keeper for the magnet. Ceramic magnets may be economically employed in the magnetic latches of this invention, but other types of permanent magnets are also satisfactory.

Where there is a single latch 21 between the seat and cover, it is positioned midway between the hinge arms 16. However, the same latching effect can be obtained by the use of two weaker magnets symmetrically positioned along the bottom edge of the cover 13 as shown in FIG. 2.

A second magnetic latch arrangement 22 is shown between the seat 12 and cover 13 at points spaced some distance from the hinge 11. As shown in FIG. 2, this arrangement consists of a pair of magnetic latches symmetrically positioned on the perimeter of the seat 12. As illustrated in FIG. 1, the latches consist of permanent magnets embedded in the seat 12 and steel plugs serving as keepers embedded in the cover 13. Thus, when the seat 12 makes contact with the bumpers 19, the attraction of the magnets with their associated keeper plugs maintains the contact whether the seat and cover are in horizontal closed position or vertical open position. As in the case of the magnetic latch 21, the parts of the magnetic latch arrangement 22 could be reversed with the magnet portion being embedded in the cover 13 and the plug or keeper portion being embedded in the seat 12. As previously described, the latches may be composed of two magnets rather than a single magnet with a keeper but such structure would normally be more expensive. If the magnetic latch arrangement 22 consists of a single magnetic latch, it is positioned midway between the two latches illustrated in FIG. 2 and at the portion of the seat perimeter farthest removed from the hinge 11.

The magnetic bias of the latch 21 is made strong enough to hold the cover 13 firmly in upright position but not so strong that the cover will not hold a horizontal position. The magnetic bias of the magnetic latch arrangement 22 must be strong enough to hold the seat 12 firmly against the cover 13 when these members are in vertical position. However, the bias should not be so great that when the seat 12 and cover 13 are in horizontal position raising the cover 13 will pull the seat 12 along with it.

The cooperation of the latch 21 and latch arrangement 22 can now be perceived. With the seat 12 and cover 13 in the horizontal position, raising the cover 13 will break the hold of the latch 22 and — when a vertical position is reached — the latch 21 will hold the cover in such position. If, instead of the cover 13, the seat 12 is raised, both members will assume a vertical position and be held there by the latch 21 and latch arrangement 22. If both the seat and cover are in vertical position and it is desired to place them in horizontal position, the seat 12 may be lowered and will draw the cover 13 with it. If it is desired to lower the seat 12 while leaving the cover 13 in vertical position, manual pressure must be exerted between the two members in order to break the grip of the latch arrangement 22 and lower the seat 12 to horizontal position.

While the invention has been described with reference to certain specific embodiments, it is obvious that there may be variations which properly fall within the scope of the invention. Accordingly, the invention should be limited in scope only as may be necessitated by the scope of the appended claims.

What I claim as new and desire to secure by letters patent of the United States is:

1. A toilet seat assembly comprising a toilet seat, a cover for said seat, and a hinge connecting said cover to said seat, said hinge having a stationary portion which includes means for mounting said hinge on a toilet bowl, a first magnetic latch positioned between the stationary portion of said hinge and the edge of said cover adjacent said hinge, said latch comprising a magnet securely positioned on one or the other of said stationary hinge portion or cover and a means securely position on the other of said stationary hinge portion or cover and in vertical alignment with said magnet when said cover is in vertical position, said first magnetic latch being operable to maintain said cover in vertical position when the assembly is mounted on a toilet bowl, and a second magnetic latch positioned between said cover and said seat at a point spaced from said hinge, said second magnetic latch being operable to maintain said seat and cover in close proximity to each other.

2. An assembly as claimed in claim 1 wherein the stationary portion of the hinge and the portion of the cover adjacent the stationary portion of the hinge contain two spaced magnetic latches.

3. An assembly as claimed in claim 2 wherein there are two magnetic latches between the cover and seat at points spaced from the hinge.

4. An assembly as claimed in claim 1 wherein there are two magnetic latches between the cover and seat at points spaced from the hinge.

* * * * *